US011286442B2

(12) United States Patent
Housel et al.

(10) Patent No.: US 11,286,442 B2
(45) Date of Patent: Mar. 29, 2022

(54) METHOD OF LUBRICATING FOOD PROCESSING EQUIPMENT AND RELATED FOOD GRADE, HIGH TEMPERATURE LUBRICANTS AND COMPOSITIONS

(71) Applicant: ZSCHIMMER & SCHWARZ, INC., Milledgeville, GA (US)

(72) Inventors: Tyler Housel, Lansdale, PA (US); Rocco Burgo, Mullica Hill, NJ (US)

(73) Assignee: Zschimmer & Schwarz, Inc., Milledgeville, GA (US)

( * ) Notice: Subject to any disclaimer, the term of this patent is extended or adjusted under 35 U.S.C. 154(b) by 0 days.

(21) Appl. No.: 16/893,097

(22) Filed: Jun. 4, 2020

(65) Prior Publication Data

US 2020/0299606 A1 Sep. 24, 2020

Related U.S. Application Data

(63) Continuation of application No. 12/477,795, filed on Jun. 3, 2009, now abandoned.

(60) Provisional application No. 61/058,493, filed on Jun. 3, 2008.

(51) Int. Cl.

| | |
|---|---|
| ***C10M 169/04*** | (2006.01) |
| ***C10M 105/38*** | (2006.01) |
| *C10N 10/04* | (2006.01) |
| *C10N 20/00* | (2006.01) |
| *C10N 30/02* | (2006.01) |
| *C10N 30/06* | (2006.01) |
| *C10N 30/08* | (2006.01) |
| *C10N 30/10* | (2006.01) |

(Continued)

(52) U.S. Cl.

CPC ..... *C10M 169/044* (2013.01); *C10M 105/38* (2013.01); *C10M 169/04* (2013.01); *C10M 2201/056* (2013.01); *C10M 2201/1056* (2013.01); *C10M 2203/1006* (2013.01); *C10M 2205/0285* (2013.01); *C10M 2207/024* (2013.01); *C10M 2207/025* (2013.01); *C10M 2207/026* (2013.01); *C10M 2207/044* (2013.01); *C10M 2207/289* (2013.01); *C10M 2207/2835* (2013.01); *C10M 2207/401* (2013.01); *C10M 2213/0626* (2013.01); *C10M 2215/064* (2013.01); *C10M 2215/065* (2013.01); *C10M 2215/223* (2013.01); *C10M 2219/0445* (2013.01); *C10M 2219/084* (2013.01); *C10M 2223/043* (2013.01); *C10M 2223/047* (2013.01); *C10N 2010/04* (2013.01); *C10N 2020/069* (2020.05); *C10N 2020/071* (2020.05); *C10N 2030/02* (2013.01); *C10N 2030/06* (2013.01); *C10N 2030/08* (2013.01); *C10N 2030/10* (2013.01); *C10N 2030/62* (2020.05); *C10N 2030/74* (2020.05); *C10N 2050/10* (2013.01)

(58) Field of Classification Search

CPC ..... C10M 169/044; C10M 105/38; C10M 169/04; C10M 2201/056; C10M 2207/401; C10M 2223/047; C10M 2207/026; C10M 2203/1006; C10M 2207/024; C10M 2207/2835; C10M 2223/043; C10M 2207/289; C10M 2215/065; C10M 2207/025; C10M 2205/0285; C10M 2201/1056; C10M 2207/044; C10M 2213/0626; C10M 2219/0445; C10M 2219/084; C10M 2215/223; C10M 2215/064; C10N 2010/04; C10N 2020/069; C10N 2020/071; C10N 2030/02; C10N 2030/06; C10N 2030/08; C10N 2030/10; C10N 2030/62; C10N 2030/74; C10N 2050/10

See application file for complete search history.

(56) References Cited

U.S. PATENT DOCUMENTS

| | | | |
|---|---|---|---|
| 5,102,567 | A | 4/1992 | Wolf |
| 6,004,909 | A | 12/1999 | Lindman |

(Continued)

FOREIGN PATENT DOCUMENTS

| | | | |
|---|---|---|---|
| CA | 2726988 | C | 2/2015 |
| DE | 4229383 | A1 | 3/1994 |

(Continued)

OTHER PUBLICATIONS

European Search Report and Search Opinion Received for EP Application No. 09759357, dated Mar. 8, 2012, 7 pages.

(Continued)

*Primary Examiner* — Taiwo Oladapo

(74) *Attorney, Agent, or Firm* — Smith, Gambrell & Russell LLP

(57) ABSTRACT

Methods of lubricating food processing equipment that include applying a food grade, high temperature lubricant composition to the food processing equipment are described. The composition includes a polyol polyester base oil that is a reaction product of at least one neopentyl polyhydric alcohol and at least one monocarboxylic acid. Also described are methods of preparing a food grade, high temperature composition comprising reacting at least one neopentyl polyhydric alcohol and at least one monocarboxylic acid. The composition may be a lubricant composition. Additionally, the invention provides a food grade, high temperature lubricant composition comprising a polyol polyester base oil that is a reaction product of at least one neopentyl polyhydric alcohol and at least one monocarboxylic acid.

10 Claims, No Drawings

(51) Int. Cl.
*C10N 30/00* (2006.01)
*C10N 50/10* (2006.01)

(56) References Cited

U.S. PATENT DOCUMENTS

| | | | | |
|---|---|---|---|---|
| 6,436,881 | B1 * | 8/2002 | McHenry | C10M 135/30 508/280 |
| 2002/0137640 | A1 | 9/2002 | Memita et al. | |
| 2004/0092411 | A1 | 5/2004 | Godici et al. | |
| 2007/0179069 | A1 | 8/2007 | Burgo et al. | |
| 2008/0317964 | A1 * | 12/2008 | Burgo | C10M 105/44 427/427.5 |
| 2009/0298731 | A1 | 12/2009 | Housel et al. | |

FOREIGN PATENT DOCUMENTS

| | | | | |
|---|---|---|---|---|
| DE | 102006043747 | A1 | 3/2008 | |
| EP | 2318492 | A1 | 5/2011 | |
| WO | 2003/031543 | A2 | 4/2003 | |
| WO | 2006/086752 | A1 | 8/2006 | |
| WO | WO-2006086752 | A1 * | 8/2006 | C10M 105/44 |
| WO | 2009/149198 | A1 | 12/2009 | |

OTHER PUBLICATIONS

Final Rejection dated Feb. 24, 2012 for U.S. Appl. No. 12/477,795.
Final Rejection dated May 25, 2016 for U.S. Appl. No. 12/477,795.
Final Rejection dated Oct. 23, 2018 for U.S. Appl. No. 12/477,795.
International Preliminary Report on Patentability received for PCT Patent Application No. PCT/US2009/046151, dated Dec. 16, 2010, 8 pages.
International Search Report and Written Opinion received for PCT Patent Application No. PCT/US2009/046151, dated Jul. 31, 2009, 8 pages.
Non-Final Rejection dated Apr. 30, 2018 for U.S. Appl. No. 12/477,795.
Non-Final Rejection dated Aug. 4, 2011 for U.S. Appl. No. 12/477,795.
Non-Final Rejection dated Aug. 16, 2013 for U.S. Appl. No. 12/477,795.
Non-Final Rejection dated Dec. 18, 2015 for U.S. Appl. No. 12/477,795.
Non-Final Rejection dated Jan. 4, 2017 for U.S. Appl. No. 12/477,795.
Non-Final Rejection dated Nov. 25, 2014 for U.S. Appl. No. 12/477,795.

* cited by examiner

METHOD OF LUBRICATING FOOD PROCESSING EQUIPMENT AND RELATED FOOD GRADE, HIGH TEMPERATURE LUBRICANTS AND COMPOSITIONS

CROSS REFERENCE TO RELATED APPLICATION

This application is a continuation of U.S. patent application Ser. No. 12/477,795 filed on Jun. 3, 2009, which claims benefit of and priority to U.S. Provisional Patent Application No. 61/058,493 filed on Jun. 3, 2008, both of which are incorporated by reference in their entirety herein.

BACKGROUND OF THE INVENTION

Food processing includes various heating steps such as cooking, baking, boiling, roasting, braising, sterilizing, drying, broiling, steaming, and frying. Industrial equipment is often used to mix, stir, convey, carry, form, sort, press, chop, cut, fold, flip, package, or in other ways to handle the food ingredients as they go through the heating steps. The food ingredients can reach temperatures of 300° C. or higher for one or more hours. Often food processing equipment is subject to the same or higher temperatures, and will be subjected to thousands of heat cycles per year, requiring lubricants with sustained high temperature performance.

Lubricants are necessary for moving parts in food processing equipment, including those subject to high temperatures. To provide adequate lubrication throughout the processes, a liquid film of lubricant must remain between metal parts in rubbing, sliding or rolling contact. Therefore, the lubricant cannot evaporate or solidify at the peak processing temperature. Lubricants that can maintain their structure under extremes of temperature are useful and essential in many commercial, domestic and industrial food processing applications.

Often, however, the conventional lubricants degrade and become ineffective. The primary mechanisms for degradation at these high temperatures are oxidative and/or thermal breakdown, and polymerization. Breakdown, in which scission of the lubricant molecule occurs, leads to the formation of lower molecular weight volatile compounds. Evaporation of these compounds can cause changes in viscosity, oil loss, and the production of excessive smoke. This can lead to poor lubrication, higher cost, reduced cleanliness of the plant, poor product quality, and higher exposure to organic compounds. Polymerization leads to formation of insoluble gums and varnishes that can build up in the work environment. Cleaning these deposits requires an increase in maintenance and generates chemical waste materials for disposal. Further, production time is lost as machinery is taken out of service for cleaning.

Generally, current high temperature lubrication methods consist of dry lubrication technology such as the application of suspensions of graphite in a volatile solvent, and liquid lubrication through the use of more thermally stable organic lubricants. In dry lubrication, graphite typically builds up over time, resulting in a loss of lubrication, and requiring significant time, work and lost production to clean the deposits. Although this method is still employed, liquid lubrication technology has become preferred.

Industrial lubricants generally employ different base oils depending on the severity of the application. Lower temperature lubricants generally use base oils consisting of hydrocarbons or vegetable- or animal-based esters, or mixtures thereof. Synthetic esters, particularly those based on neopolyol chemistry, provide significantly better oxidative and thermal stability. For industrial applications, neopolyol esters are the preferred base oil when the lubricant must perform for longer times at higher temperatures. Unfortunately, the neopolyol synthetic esters have not historically been approved for food processing applications as none has been identified as a food grade lubricant.

Because lubricants are used in environments where food is processed and packaged, toxicity and safety of the material is of paramount concern. Most industrialized countries, including the United States, regulate these materials to ensure the safety of food products. In the United States for example, these substances are regulated as "food additive" in recognition of the fact that the substances may be incidentally incorporated into foodstuffs during the manufacturing process.

For use as a lubricant approved for incidental contact with food, the lubricant must only contain substances that are: (i) generally recognized as safe (GRAS) for use in food, (ii) specifically identified in the FDA regulations as being safe, or (iii) approved or sanctioned by the FDA prior to use. See, 21 C.F.R. 178.3570 (2007), the contents of which are incorporated herein by reference. If a lubricant meets these criteria, it may be used in lubricating applications where it may incidentally contact food.

NSF International (website nsf.org) maintains uniform standards for products such as incidental food additives and lubricants and its ratings are relied upon throughout the world by processers. If the FDA criteria listed above are met for a given substance, NSF International grants the lubricant composition a rating of H1, indicating that the substance is a lubricant suitable for food contact.

Many lubricants based on mineral oils, synthetic hydrocarbon oils or vegetable oils have an NSF International H1 ranking. These base fluids have relatively poor performance at high temperatures, either because of inadequate viscosity, excessive evaporation or formation of solid, non-lubricious deposits. Therefore, a need exists for a lubricant formulation with superior high temperature fluidity that can be used to lubricate food processing machinery that is routinely exposed to high temperatures and which is safe for food contact.

BRIEF SUMMARY OF THE INVENTION

The invention provides methods of lubricating food processing equipment that include applying a food grade, high temperature lubricant composition to the food processing equipment. The composition comprises a polyol polyester base oil that is a reaction product of at least one neopentyl polyhydric alcohol and at least one monocarboxylic acid.

Also provided are methods of preparing a food grade, high temperature composition comprising reacting at least one neopentyl polyhydric alcohol and at least one monocarboxylic acid. The composition may be a lubricant composition.

Additionally, the invention provides a food grade, high temperature lubricant composition comprising a polyol polyester base oil that is a reaction product of at least one neopentyl polyhydric alcohol and at least one monocarboxylic acid.

DETAILED DESCRIPTION OF THE INVENTION

The invention provides (i) methods of lubricating food processing equipment using a food grade, high temperature lubricant composition, (ii) methods of preparing a food grade, high temperature composition that may be a lubricant, and (iii) a food grade, high temperature lubricant composition for use on food processing equipment. Each incorporates a base oil that is a reaction product of at least one neopentyl polyhydric alcohol and at least one monocarboxylic acid. The process, lubricant compositions, and methods have in common a high temperature, food grade composition that exhibits desirable viscosity, viscosity-temperature behavior, oxidation resistance, flash point, anti-wear behavior, and friction reduction when used in food processing applications and is sufficiently safe to be considered food grade and/or achieve an H1 rating under the NSF International system.

Methods of processing foods using processing, equipment that has been lubricated with a high temperature, food grade lubricant composition that includes a polyol polyester base oil that is a reaction product of at least one neopentyl polyhydric alcohol and at least one monocarboxylic acid are also disclosed.

By "food grade" it is meant a composition or lubricant that meets the criteria set forth by the United States Food and Drug Administration for foods additives and/or lubricants with incidental food contact, for example, as set out in 37 C.F.R. § 178.3570 (2007), the contents of which are incorporated herein by reference, and/or which meet the criteria to achieve an "H1" classification from NSF International or an equivalent rating or classification from a counterpart standards setting body.

By "high temperature" lubricant it is meant compositions that can be exposed to temperatures of about 250° C. to 300° C. or greater for short duration exposure of less than one minute to exposures of several weeks without undergoing substantial degradation, such as oxidative breakdown, thermal breakdown and/or polymerization.

The invention provides a food grade, high temperature composition that can be used in and around food processing and preparing activities and incorporated incidentally into processed foods.

The composition includes a polyol polyester base oil ("base oil") that is a reaction product of at least one neopentyl polyhydric alcohol and at least one monocarboxylic acid. Properties of these polyol polyesters such as viscosity, viscosity-temperature behavior, oxidation resistance, evaporation loss, hydrolytic stability, and flash point can be modified by selection of the polyol and monocarboxylic acids used to prepare the base oil, and/or by the manufacturing process employed. One of ordinary skill in the art may make such modifications as desired, depending on the end use of the product.

The neopentyl polyhydric polyol may have any suitable number of hydroxyl groups. It may be preferred that the neopentyl polyhydric polyol has about 3 to about 12 or about 4 to about 8 hydroxyl groups. Commercially available polyols of this type are, for example, trimethylolpropane, trimethylolethane, pentaerythritol, dipentaerythritol, tripentaerythritol, and tetrapentaerythritol. Preferred polyols may be dipentaerythritol, monopentaerythritol and trimethylolpropane or combinations thereof, although tripentaerythritol, and tetrapentaerythritol may be utilized.

The selected neopentyl polyhydric alcohol is reacted with at least one monocarboxylic acid. More than one may be combined; it may be desirable that at least two, three, four, or five monocarboxylic acids are used. Each monocarboxylic acid may have a structure different from the other(s), differing either in type and/or number of chemical constituents that make up the structure or in the arrangement of the constituents relative to one another (e.g., branched chains versus straight chains). The monocarboxylic acid(s) may be straight chain (linear) or branched chain (or any combination of these). It may be preferred that the monocarboxylic acid(s) (branched or straight chain) contain about 2 to about 20 carbon atoms, about 5 to about 12 carbon atoms, or about 5 to about 10 carbon atoms. In some stances, shorter chain length linear carboxylic acids may be preferred because thermal stability may decrease as carbon chain length increases.

Examples of linear monocarboxylic acids that may be used include pentanoic acid, decanoic acid, hexanoic acid, heptanoic acid, octanoic acid and nonanoic acid. Branched chain monocarboxylic acids may also be used, either alone or in combination with the linear or straight chained monocarboxylic acids. For example, one may increase the amount of branched chain monocarboxylic acids to modify (raise) the viscosity of the end composition. Branched chain monocarboxylic acids that may be suitable include, without limitation, 2-ethylhexanoic acid and 3,5,5-trimethylhexanoic acid (isononanoic acid).

In an embodiment, the base oil is prepared from the reaction of at least one neopentyl polyhydric alcohol that includes dipentaerythritol and at least one monocarboxylic acid that is pentanoic acid, heptanoic acid, 3,5,5-trimethyl hexanoic acid and/or any combination of these.

In addition to the base oil described above, the composition may include one or more additional additives to modify the thermal, chemical, aesthetic, or other properties of the composition. Any additive may be used as long as the nature of the substance, and/or the amount used does not substantially affect the food grade status of the finished composition. For example, any additive that meets the FDA criteria set out in its regulations as a food additive that is safe for incidental contact with food may be used. Thus, all GRAS foodstuff and food additive materials and materials rated H1 or HX-1 by NSF International may be included, as well as those materials specifically set forth by the FDA as safe for use in food or as food additives (direct or incidental contact) including: aluminum stearoyl benzoyl hydroxide; N,N-Bis(2-ethylhexyl)-ar-methyl-1H-benzotriazole-1-methanamine; BHT; BAH, alpha-butyl-omega-hydroxypoly (oxyethylene) poly(oxypropylene) produced by random condensation of a 1:1 mixture by weight of ethylene oxide and propylene oxide with butanol; castor oil; alpha-butyl-omega-hydroxypoly(oxyethylene) poly(oxypropylene); dialkyldimethylammonium aluminum; dimethylpolysiloxane; di (n-octyl) phosphate; disodium decanedioate; disodium EDTA; ethoxylated resin phosphate ester mixtures consisting of: poly(methylene-p-tert-butyl-phenoxy)poly-(oxyethylene) mixture of dihydrogen phosphate and monohydrogen phosphate esters, poly(methylene-p-nonylphenoxy) poly(oxyethylene) mixture of dihydrogen phosphate and monohydrogen phosphate esters and n-tridecyl alcohol mixture of dihydrogen phosphate and monohydrogen phosphate esters; fatty acids derived from animal or vegetable sources, and the hydrogenated forms of such fatty acids; 2-(8-Heptadecenyl)-4,5-dihydro-1H-imidazole-1-ethanol; hexarnethylenebis(3,5-di-tert-butyl-4-hydroxyhydrocinnamate)1; alpha-hydro-omega-hydroxypoly (oxyethylene) poly(oxypropylene); 12-hydroxystearic acid; isopropyl oleate; magnesium ricinoleate; mineral oils; petrolatum; N-methyl-N-(1-oxo-9-octadecenyl)glycine; N-phenylbenzenamine; phenyl-alpha- and/or phenyl-beta-naphthylamine; phosphoric acid, mono- and dihexyl esters, compounds with tetramethylnonylamines and alkylamines; phosphoric acid, mono- and diisooctyl esters, reacted with tert-alkyl and (C—C) primary amines; phosphorothioic acid, 0, 0, 0-triphenyl ester, tert-butyl derivatives; polyurea; polybutene; polyethylene; polyisobutylene; sodium nitrite; tetrakis [methylene(3,5-di-tert-butyl-4-hydroxyhydro-cinnamate)] methane; thiodiethylenebis (3,5-di-tert-butyl-4-hydroxyhydrocinnamate); tri[2(or 4)-C-branched alkylphenyl] phosphorothioate; triphertyl phosphorothionate; tris(2,4-di-tert-butylphenyl)phosphate; thiodiethylenebis(3,5-di-tert-butyl-4-hydroxy-hydro-cinnamate; and zinc sulfide.

Suitable optional additives may include aesthetic/organoleptic agents, one or more antioxidants (or an antioxidant system), rheology modifiers, metal passivating agents, dry lubricants (such as graphite), other liquid lubricants, lubricating property modifiers (additives for improving one or more lubricating properties) and combinations of one or more of these additives.

Aesthetic/organoleptic agents include any that modify the taste, smell, color, or other aesthetic or organoleptic qualities of the composition, including agents that disguise or reduce the perception of undesirable qualities and agents which may serve as indicators, e.g., an agent that turns color or hue to indicate that the lubricant composition must be replaced. Examples include colorants, fragrances, flavorants, and odor reducers.

Additives that act as antioxidants may be any capable of slowing or preventing the oxidation of one or more components in the composition. Suitable antioxidants may include, but are not limited to, diaromatic amines, phenolics, thiophenolics, phosphites and combinations thereof. Commercial examples include:

(i) IRGANOX® 1010 (benzenepropanoic acid, 3,5-bis(1,1-dimethylethyl)-4-hydroxy-,2,2-bis[[3-[3,5-bis(1,1-dimethylethyl)-4-hydroxyphenyl]-1-oxopropoxy]methyl]-1,3-propanediyl ester, CAS number [6683-19-8]);

(ii) IRGANOX® L06 (alkylated phenyl alpha naphthylamine or N-phenyl-ar-(1,1,3,3,-tetramethylbutyl)-1-naphthalenamine. CAS number [68259-36-9]);

(iii) IRGANOX® L01 (di-octylated diphenylamine), (iv) IRGANOX® L57 (a mixture of alkylated diphenylamines);

(v) IRGANOX® L150 (a mixture of aminic and high molecular weight phenolic antioxidants);

(vi) IRGANOX® L64 (a mixture of mono- and dialkyl butyl/octyl diphenylamines);

(vii) IRGANOX® 1035 (a mixture containing thiodiethylene bis (3,5-di-tert-butyl-4-hydroxyhydrocinnamate);

(viii) IRGANOX® L101 (a mixture containing tetrakis [methylene-3-(3,5-di-t-butyl-4-hydroxyphenyl) propionato] methane);

(ix) IRGANOX® L109 (benzenepropanoic acid, 3,5-bis (1,1-di ethyl)-4-hydroxy-,1,6-hexanediyl ester, CAS number [35074-77-2]);

(x) IRGANOX® L115 (benzenepropanoic acid, 3,5-bis (1,1-dimethylethyl)-4-hydroxy-,thiodi-2,1-ethanediyl ester, CAS number [41484-35-9]);

(xi) IRGANOX® E201 (liquid d1-alpha tocopherol; 2H-1-Benzopyran-6-ol, 3,4-dihydro-2,5,7,8-tetramethyl-2-(4,8,12-trimethyltridecyl)-, CAS number [10191-41-0]); and (xii) IRGAFOS® 168 (a mixture containing tris(2,4-di-tert-butylphenyl)phosphate); all from Ciba Specialty Chemicals, Basel, Switzerland.

Also included may be the antioxidants:

(i) ADDITIN® RC7130 (N-phenyl-1-naphthyl amine, CAS number [90-30-2]) from Rhein Chemie Corporation, Chardon, Ohio);

(ii) NA-LUBE® AO142 (a liquid diphenylamine-based antioxidant) (from King Industries, Norwalk, Conn., United States);

(iii) VANLUBE® 961 (mixed octylated and butylated diphenylamine or benzeneamine,-N-phenyl-, reaction product with 2,4,4-trimethylpentane and 2-methylpropene, CAS number [184378-08-3]); and (iv) VANLUBE® PCX (a mixture containing 1-hydroxy-4-methyl-2,6-di-ten-butylbenzene); each from R. T. Vanderbilt, Norwalk, Conn., United States.

Each antioxidant may be included in the composition alone, or one or more of the antioxidants can be combined into an antioxidant system. The antioxidant(s) may be present in any desired amount as long as the amounts and/or type of antioxidants selected do not substantially affect the food grade property of the composition. In some embodiments, the antioxidant system preferably includes at least three antioxidants, at least four or at least five antioxidants. Additionally, the antioxidant system may include other substances that function to stabilize or otherwise maintain the antioxidant(s). In a preferred embodiment, the antioxidant system (e.g., sum total of all) is present at a level of about 0.5% to about 4% by weight of the final composition or alternatively about 1% to about 5% by weight of the composition.

In an embodiment, the composition contains an antioxidant system containing at least three, at least four or at least five antioxidants chosen from: (a) benzenepropanoic acid, 3,5-bis(1,1-dimethylethyl)-4-hydroxy-,2,2-bis[[3-[3,5-bis(1,1-dimethylethyl)-4-hydroxyphenyl]-1-oxopropoxy] methyl]-1,3-propanediyl ester (CAS number [6683-19-8]); (b) alkylated phenyl alpha naphthylamine or N-phenyl-ar-(1,1,3,3,-tetramethylbutyl)-1-naphthalenamine (CAS number [68259-36-9]); (c) benzenepropanoic acid, 3,5-bis(1,1-dimethyl)-4-hydroxy-,1,6-hexanediyl ester (CAS number [35074-77-2]); (d) benzenepropanoic acid, 3,5-bis(1,1-dimethylethyl)-4-hydroxy-,thiodi-2,1-ethanediyl ester (CAS number [41484-35-9]); (e) a mixture containing 1-hydroxy-4-methyl-2,6-di-tert-butylbenzene; (f) N-phenyl-1-naphthyl amine (CAS number [90-30-2]); (g) a liquid diphenylamine-based antioxidant) and (h) mixed octylated and butylated diphenylamine or benzeneamine,—N-phenyl-, reaction product with 2,4,4-trimethylpentane and 2-methylpropene (CAS number [184378-08-3]); and (i) liquid dl-alpha tocopherol; 2H-1-Benzopyran-6-ol, 3,4-dihydro-2,5,7,8-tetramethyl-2-(4,8,12-trimethyltridecyl)-(CAS number [10191-41-0]). In an embodiment, the antioxidants (a) to (h) (i.e., all but the tocopherol), above, if selected to be included in the system, may be present independently in an amount of about 0.1 weight % to about 0.5 weight %, each.

One or more additives that serve as rheology modifiers, such as grease thickeners, food grade greases, and rheologically modified oils may be included. Suitable rheological modifier can include additives that are used to improve the adhesion of the lubricant to metal parts, or impart some rheological advantage to the lubricant. Some commercial examples are BARAGEL® 3000, BENTONE® 34, NYKON® 77 (from Elementis Specialties Hightstown, N.J., United States), FLUORO® FG, MICROFLON® 1433FG, MICROFLON® 1437FG, (from Shamrock Technologies, Newark, N.J., United States), V-421, V-422, V-425, V-498, V-584 (Functional Products), TPC® Polyisobutylene 1105 and other grades (from Texas Petrochemicals, Houston, Tex., United States), Fumed Silica HDK® H15, HDK® H18, HDK® T40 (from Wacker Chemical. Corporation, Adrian, Mich., United States), Boron Nitride Powder Grade AC6003 and other BN grades (from Momentive Performance Materials, Strongville, Ohio, United States), Tackifier FG, Calciplex FG 1605, FG 1606, FG1607, FG1608 (OMG), INSTA-GREASE® and Tri-XL-LV® (from Chattem Chemicals, Chattanooga, Tenn., United States).

The selected rheology modifiers may be present in any amount; in an embodiment it is preferred that the rheology modifier is present in an amount of about 0.2% to about 20%, or to about 60% by weight of the total composition or about 4% to about 11% of the total composition.

In some embodiments, the composition may include one or more metal passivating agents ("MPA"). Any substance that renders a metal less active may be incorporated into the composition as an MPA and can include corrosion inhibitors, metal deactivators, or ion sequesterants. The MPA can include but is not limited to triazoles, imidazolines, sarcosines, benzotriazole derivatives, and amine phosphates. Commercial examples include IRGAMET® 39, IRGACOR® DSS G, Amine O, SARKOSYL® O (Ciba), COBRATEC® 122 (PMC Specialties, Cincinnati, Ohio, United States), CUVAN® 303, VANLUBE® 9123 (Vanderbilt), CI-426, CI-426EP, CI-429 and CI-498 (from Functional Products, Macedonia, Ohio, United States)

Any amount of MPA may be included. In one embodiment, the MPA is present in an amount of about 0.01% to about 5% by weight of the final composition or, for example, the MPA is present in an amount of about 0.05% to about 1% by weight of the final composition or less than 1% of the total composition by weight.

The composition may include one or more lubricating property modifier, i.e., any agent for improving lubricity. The modifier may include pressure/antiwear agents and friction modifiers. At least one such modifier may be present, for example, in an amount of about 0.05% to about 3% by weight of the final composition. In a preferred embodiment, the modifier is present at a level from about 0.1% to about 2% by weight of the final composition. The modifier may include but is not limited to amines, amine phosphates, phosphates, thiophosphates, phosphorothionates and combinations thereof. Commercial examples include IRGALUBE® TPPT, IRGALUBE® 232, IRGALUBE® 349, IRGALUBE® 211 (Ciba), and ADDITIN® RC3760 Liq 396D (Rhein Chemie), FRIC-SHUN® FG 1505 and FG 1506 (from OMG Americas, Westlake, Ohio), NA-LUBE® KR-015FG (King), LUBEBOND® (from Nowear Technologies, Scottsdale, Ariz., United States), FLUORO® FG (from Shamrock Technologies, Newark, N.J., United States), SYNALOX® 40-D series Lubricants (from Dow Chemical Company, Midland, Mich., United States), ACHESON® FGA 1820 and ACHESON® FGA 1810 (from Acheson Colloids, Port Huron, Mich., United States). The modifier may be present in an amount of about 1% or less by weight of the total composition.

Any or all of these additives may be present in the composition as long as the additive, either individually or combined, does not substantially affect the food grade properties of the composition, e.g., it does not render a composition deemed to be food grade under the FDA regulations and or the NSF International rating system to be a non-food grade composition. In some embodiments, one may select and combine the additives to optimize the high temperature performance of the finished lubricant or composition. It may be preferred that the composition contains mixtures of three or more additives or up to about five additives.

The kinematic viscosity and/or the flash point of the composition will vary, as is understood by a person of skill in the art, depending on the specific ingredients used in the composition. However, in an embodiment, the composition has a kinematic viscosity at 40° C. of about 60 to about 400 centistokes and/or a flash point of at least about 270° C.

Food processing equipment may be treated with the food grade, high temperature lubricant composition of the invention. Such equipment can include any used to cook, prepare, process, or package any food or any element that comes in direct contact with food, including, for example, beverages, baked goods, dairy products, pre-prepared frozen or shelf stable foods, canned foods, packed meats, vegetables, fruits, and pastas, processed nuts, candies or other confections. Such equipment may include, for example, devices and machinery used in processes of cooking, baking, boiling, roasting, braising, sterilizing, drying, broiling, steaming, and flying, chopping, mixing, stirring, conveying, pressing, carrying, forming, sorting, cutting, folding, flipping, packaging, or handling the food ingredients under heat. Examples include ovens, conveyor belts, mixers, tanks, vats, grills, heated surfaces, presses, molds, pans, pots, curd presses, fermentation tanks, food handling implements and utensils, sorters, fruit washers, dishwashers, and the like. Additionally, the equipment to which the lubricant is applied may be any that is used to process products placed in close contact with mammalian tissues, even though the products are necessarily ingested. For example, such equipment may include equipment used in the manufacture of pharmaceuticals, vitamins, contact lenses, dermal patches, soaps, shampoos, oral care products, medical devices, bandages, diapers, medical implements and the like.

The food grade, high temperature lubricant may be applied to the equipment by any means. In an embodiment the application of the composition to the equipment may include spraying, dipping, brushing, wiping, sponging, flushing or irrigating. The application may be accomplished manually or may be an automated process.

EXAMPLES

In each of the examples included herein, kinematic viscosity was tested using ASTM official method number D-445-97 (1997) (ASTM International, West Conshohocken, Pa., United States), viscosity index (VI) was determined using ASTM D-2270, flash point was determined using ASTM D-92, and evaporation loss using ASTM D-972. Frictional and antiwear properties were determined using the four-ball method under ASTM D-4172 and the Falex method under ASTM D-2670. Oxidation resistance was measured under ASTM D-4636 and ASTM D-2272. The contents of each of these ASTMs are available from ASTM International, West Conshohoken, Pa., United States and are well known to a person of skill in the art.

Other test methods used were the "hot plate test" and the "oven pan test". These tests allow for rapid screening of additive systems and show distinct differences in evaporation loss and deposit formation at high temperature.

Hot Plate Test

Data for the hot plate test results were collected as follows: 1±0.05 grams of each sample is weighed into an aluminum dish and subsequently placed on a hot plate for 15 minutes at a heat setting of 6.25. The sample is reweighed to determine evaporative weight loss, and the level of deposits is visually ranked on a scale of 1 (no deposits) through 10 (very heavy deposits). Finally, each aluminum dish is held at an angle of 105 degrees from the horizontal, and the sample is allowed to drain for 10 minutes. The pan is weighed again to determine the residue in the pan and (by difference) the amount of liquid that flowed out (liquid fraction). Each sample is tested at least twice and averages are reported. A good high temperature lubricant will have low weight, loss, deposits and residue. The major proportion of a good lubricant will be recorded as the liquid, fraction.

Oven Pan Test

Data for the oven plan test results were collected as follows:

The oven pan test is similar to the hot plate test, but it uses a forced air oven to heat the samples. Twelve lubricant samples are covered and placed in the oven together. The test typically runs for 4 to 24 hours at 260° C. although other times and temperatures can also be used. In the oven pan test, the initial sample weight is 2±0.05 grams.

Example 1

Preparation of Base Oil

A synthetic neopolyol ester base oil was prepared by combining the materials of Table 2 in a batch reactor fitted with a mechanical stirrer, inert gas sparge, vapor column, condenser, and distillate receiver to form a reaction mixture.

TABLE 1

| Reaction Material | Amount (gms) |
|---|---|
| dipentaerythritol | 798 |
| pentanoic acid | 410 |
| heptanoic acid | 1642 |
| 3,5,5 trimethylhexanoic acid | 651 |

Pressure in the reactor was controlled by attaching a vacuum pump to the system. To the reaction mixture, about 0.5 parts per 100 parts (pphp) activated charcoal, 0.005 pphp sodium hypophosphite and 0.01 pphp of a tin based catalyst were added. The mixture was heated to from about 180° C. to about 250° C. Pressure was slowly reduced until sufficient conversion was obtained. The crude ester was further purified by steam distillation and filtration. The result was a light yellow liquid possessing the following properties (Table 2):

TABLE 2

| Property | Test Method Used | Result |
|---|---|---|
| Kinematic Viscosity @ 40° C., cSt | ASTM D-445 | 71 |
| Kinematic Viscosity @ 100° C., cSt | ASTM D-445 | 10 |
| Acid Value | ASTM D-3242 | 0.019 |
| Flash Point, ° C. | ASTM D-92 | 289 |

Preparation of Base Oil

Example 2

A synthetic neopolyol ester base oil was prepared by combining the materials of Table 3 in a batch reactor fitted with a mechanical stirrer, inert gas sparge, vapor column, condenser, and distillate receiver to form a reaction mixture.

TABLE 3

| Reaction Material | Amount (gms) |
|---|---|
| Dipentaerythritol | 412 |
| pentanoic acid | 38 |
| heptanoic acid | 38 |
| 3,5,5 trimethylhexanoic acid | 1613 |

Pressure in the reactor was controllable by attaching a vacuum pump to the system. To the reaction mixture, about 0.5 parts per 100 parts (pphp) activated charcoal, 0.005 pphp sodium hypophosphite and 0.01 pphp of a tin based catalyst were added and the mixture was heated to from about 180° C. to about 250° C. Pressure was slowly reduced until sufficient conversion was obtained. The crude ester was further purified by steam distillation and filtration. The result was a light yellow liquid possessing the following properties (Table 4):

TABLE 4

| Property | Test Method | Result |
|---|---|---|
| Kinematic Viscosity@40° C., cSt | ASTM D-445 | 338 |
| Kinematic Viscosity @ 100° C., cSt | ASTM D-445 | 23 |
| Acid Value | ASTM D-3242 | 0.015 |
| Flash Point, ° C. | ASTM D-92 | 307 |

Example 3

Stabilized Lubricant Examples

An experiment was designed and carried out to determine the relative benefits of five different food grade antioxidants in the base oils listed in examples above. The antioxidants included were Vanlube 961, IRGANOX® 1010, IRGANOX® L115, IRGANOX® E201 and Vanlube PCX. Base oils of examples 1 and 2 were blended to achieve a mixture having a 220 cst kinematic viscosity (at 40° C.), and then heated to 80-90° C. in a stirred vessel. Antioxidants were added and everything was mixed until a clear solution was obtained. The formulations of compositions 1-17 as well as the hot plate test results (15 minute duration) are shown below in Table 5.

TABLE 5

| Composition | Vanlube 961 | IRGANOX ® 1010 | IRGANOX ® L115 | IRGANOX ® E201 | Vanlube PCX | Weight Loss | Liquid Fraction | Percent Residue | Deposit |
|---|---|---|---|---|---|---|---|---|---|
| 1 | 0.50 | 0.50 | 0.50 | 0.50 | 0.50 | 22.9% | 59.5% | 17.6% | 4.0 |
| 2 | — | 0.50 | 0.50 | 0.50 | — | 24.1% | 57.0% | 18.9% | 4.0 |
| 3 | 0.50 | 0.50 | 0.50 | — | — | 27.1% | 53.6% | 19.3% | 4.5 |
| 4 | 0.50 | 0.50 | — | 0.50 | — | 27.8% | 53.0% | 19.2% | 4.5 |
| 5 | 0.50 | — | 0.50 | 0.50 | — | 29.8% | 49.4% | 20.8% | 4.5 |
| 6 | 0.50 | 0.50 | — | — | 0.50 | 32.5% | 47.2% | 20.3% | 5.0 |

TABLE 5-continued

| Composition | Vanlube 961 | IRGANOX ® 1010 | IRGANOX ® L115 | IRGANOX ® E201 | Vanlube PCX | Weight Loss | Liquid Fraction | Percent Residue | Deposit |
|---|---|---|---|---|---|---|---|---|---|
| 7 | — | 0.50 | 0.50 | — | 0.50 | 35.1% | 43.2% | 21.7% | 5.0 |
| 8 | 0.25 | 0.25 | 0.25 | 0.25 | 0.25 | 36.0% | 42.6% | 21.4% | 5.5 |
| 9 | — | 0.50 | — | 0.50 | 0.50 | 37.8% | 40.6% | 21.6% | 5.5 |
| 10 | — | — | 0.50 | 0.50 | 0.50 | 39.6% | 36.9% | 23.5% | 6.0 |
| 11 | 0.50 | — | — | 0.50 | 0.50 | 43.6% | 33.5% | 22.9% | 6.5 |
| 12 | 0.50 | — | 0.50 | — | 0.50 | 44.0% | 32.9% | 23.1% | 7.0 |
| 13 | — | 0.50 | — | — | — | 45.1% | 31.0% | 23.9% | 6.5 |
| 14 | 0.50 | — | — | — | — | 45.9% | 28.8% | 25.3% | 6.5 |
| 15 | — | — | 0.50 | — | — | 46.7% | 26.0% | 27.3% | 7.5 |
| 16 | — | — | — | 0.50 | — | 47.6% | 27.5% | 24.9% | 7.5 |
| 17 | — | — | — | — | 0.50 | 51.1% | 22.7% | 26.2% | 8.0 |

This data demonstrates that formulations with one antioxidant perform at a level different from those containing at least three antioxidants.

Example 5

Preparation and Evaluation of a Lubricant Composition

A food grade, high temperature lubricant was prepared by mixing the ingredients in Table 6:

TABLE 6

| Ingredient | Amount (gms) |
|---|---|
| Base oil of Example 1 | 450 |
| Base oil of Example 2 | 1289 |
| IRGANOX ® L06 | 9 |
| VANLUBE ® 961 | 9 |
| IRGANOX ® 1010 | 9 |
| IRGANOX ® E201 | 18 |
| IRGANOX ® L115 | 9 |
| IRGALUBE ® 349 | 1.8 |
| IRGALUBE ® TPPT | 3.6 |
| CUVAN ® 303 (corrosion inhibitor) | 1.8 |

Two high performing, non-food grade high temperature lubricants were also evaluated as comparative examples: LEXOLUBE® POE 220HT OCL and LEXOLUBE® CPE 220 OCL, both from Inolex Chemical Company, Philadelphia, Pa. All three lubricants were evaluated and the test results are shown in Table 7.

The results demonstrate that the lubricant composition of the invention provides overall greater stability in high temperature tests than either comparative industrial lubricant. Therefore, it is suitable for use in high temperature applications and for obtaining the NSF International H1 ranking.

Example 6

Preparation and Evaluation of Food Grade Lubricant Grease

A food grade, high temperature lubricant grease having a National Grease Lubricating Institute (NGLI) rating of 2 was prepared. About two gallons of the lubricating composition of Example 1 was charged to a laboratory scale stainless steel grease mixer. Under continuous agitation, PTFE powder was slowly added; as the amount of PTFE was increased, the grease became firmer. When the amount of PTFE added was approximately 50% by weight of the total composition, the grease had reached the consistency of NGLI rating 2. Mixing was continued for an additional 30 minutes to ensure homogeneity.

To evaluate the performance characteristics of the lubricant ease composition, several commercial high temperature food grade greases were obtained. Many of these products made commercial claims to perform at temperatures between 300° F. and 700° F. Details of the sixteen comparative greases (CG) are shown in Table 8.

TABLE 7

| Property | Test Method | Example 5 Lubricant | Lexolube ® POE 220HT OCL | Lexolube ® CPE-220 OCL |
|---|---|---|---|---|
| Kinematic Viscosity@40° C., cSt | ASTM D-445 | 227 | 226 | 236 |
| Kinematic Viscosity @ 100° C., cSt | ASTM D-445 | 19 | 19 | 27 |
| Flash Point, ° C. | ASTM D-92 | 321 | 308 | 310 |
| Weight loss 4 hrs at 260° C. | Oven pan test | 3% | 3% | 3% |
| Weight loss 20 hrs at 260° C. | Oven pan test | 41% | 51% | 23% |
| Liquid fraction 20 hrs at 260° C. | Oven pan test | 28% | 3% | 0 |
| Residue 20 hrs at 260° C. | Oven pan test | 32% | 46% | 77% |
| Evaporation Loss, %, 6.5 hrs at 204° C. | ASTM D-972 | 2 | 1.7 | 2 |
| Four-Ball Wear, 100° C., 40 kg load, 1200 rpm, one hour, mm | ASTM D-4172 | 0.48 | 0.48 | 0.45 |
| Rotating Bomb Oxidation Test (RBOT), at 150° C., min. | ASTM D-2272 | 1034 | 1180 | 605 |

TABLE 8

| Comparative food grade grease samples | | | | |
|---|---|---|---|---|
| ID | NLGI # | Oil | Thickener | Claim Max Temperature |
| CG01 | 2 | Petroleum | Al complex | 500° F. |
| CG02 | 1 | Petroleum | Al complex | 500° F. |
| CG03 | 2 | Petroleum | Al Complex | 375° F. |
| CG04 | 2 | Petroleum | Aluminum | 300° F. |
| CG05 | 2 | Polyalphaolefin | PTFE | 400° F. |
| CG06 | 2 | Polyalphaolefin | Silica | 700° F. |
| CG07 | 2 | Polyalphaolefin | Silica/PTFE | 650° F. |
| CG08 | 2 | Vegetable Oil | Al complex | 500° F. |
| CG09 | 2 | Polyalphaolefin | PTFE | 600° F. |
| CG10 | 2 | Petroleum | Ca Sulfonate | 300° F. |
| CG11 | 2 | Polyalphaolefin | Ca Sulfonate | 360° F. |
| CG12 | 2 | Petroleum | Ca Sulfonate | 360° F. |
| CG13 | 2 | Polyalphaolefin | Al complex | N/a |
| CG14 | 2 | Vegetable Oil | Al complex | N/a |
| CG15 | 2 | Petroleum | Ca Sulfonate | N/a |
| CG16 | 2 | Polyalphaolefin | Ca complex | N/a |

All of the commercial grease samples were compared to the lubricant grease composition of the invention using the oven pan test using cover pans to capture vapor deposits. Three tests were performed at increasingly higher temperatures. The conditions were 20 hours at 400° F. (204° C.), 20 hours at 450° F. (232° C.) and 20 hours at 550° F. (288° C.).

TABLE 9

| Pan test conditions: 400° F. (204° C.), 20 hours | | | | |
|---|---|---|---|---|
| ID | Thickener Stability | Skinning | Weight Loss | Vapor Deposit (mg) |
| CG01 | Liquid | None | 14% | 0.7 |
| CG02 | Liquid | None | 14% | 0.4 |
| CG03 | Liquid | None | 11% | 1.2 |
| CG04 | Liquid | None | 6% | 0.8 |
| CG05 | No drop | Slight skin | 44% | 1.2 |
| CG06 | No drop | None | 8% | 1 |
| CG07 | No drop | None | 8% | 1.1 |
| CG08 | Liquid, polymerized | Yes | 11% | 0.7 |
| CG09 | No drop, some bleed | None | 4% | 0.4 |
| CG10 | Liquid | None | 13% | 0 |
| CG11 | No drop | None | 2% | 0 |
| CG12 | No drop | None | 2% | 0.3 |
| CG13 | Liquid | None | 9% | 0.4 |
| CG14 | Liquid, polymerized | Yes | 7% | 0 |
| CG15 | No drop | None | 2% | 0.4 |
| CG16 | No drop | Slight skin | 6% | 1.3 |
| Lubrication Composition of the Invention | No drop | None | 0% | 0.1 |

The samples that did not survive at 400° F. were not tested at high temperatures.

TABLE 10

| Pan test conditions: 450° F. (232° C.), 20 hours | | | | |
|---|---|---|---|---|
| ID | Thickener Stability | Skinning | Weight Loss | Vapor Deposit (mg) |
| CG05 | No drop, shrunk | Heavy skin | 55% | 2.4 |
| CG10 | Liquid | None | 23% | 1.9 |
| CG07 | No drop | Heavy skin | 14% | 1.8 |
| CG16 | No drop | Heavy skin | 11% | 1.3 |
| CG15 | Sagged | None | 5% | 1.5 |
| CG09 | No drop, heavy bleed | Slight skin | 8% | 0.5 |
| CG12 | No drop, some bleed | Slight skin | 5% | 0.5 |
| CG11 | No drop | None | 5% | 0.3 |

TABLE 10-continued

| Pan test conditions: 450° F. (232° C.), 20 hours | | | | |
|---|---|---|---|---|
| ID | Thickener Stability | Skinning | Weight Loss | Vapor Deposit (mg) |
| Lubrication Composition of the Invention | No drop | None | 2% | 0.1 |

TABLE 11

| Pan test conditions: 500° F. (260° C.), 20 hours | | | | |
|---|---|---|---|---|
| ID | Thickener Stability | Skinning | Weight Loss | Vapor Deposit (mg) |
| CG06 | No drop, heavy deposit | Solid | 35% | 27.2 |
| CG07 | No drop, heavy deposit | Heavy skin | 23% | 17.7 |
| CG16 | No drop, heavy bleed | Heavy skin | 15% | 9.3 |
| CG15 | No drop, some bleed | Heavy skin | 12% | 7.1 |
| CG12 | No drop, some bleed | Heavy skin | 11% | 6.9 |
| CG09 | No drop, heavy bleed | Solid | 16% | 6.5 |
| CG11 | No drop, some bleed | Heavy skin | 11% | 4.0 |
| Lubrication Composition of the Invention | No drop, some bleed | No skin | 10% | 3.9 |

At all temperatures, the grease of the invention had the lowest evaporation and vapor deposit. It also gave no skinning. By all three measures, it showed better performance at high temperature than the commercial high temperature food grade greases tested.

What is claimed is:

1. A high-temperature H1 food grade lubricant, comprising:

a polyol polyester base oil that consists essentially of a reaction product of at least one neopentyl polyhydric alcohol and a mixture of heptanoic acid, pentanoic acid and isononanoic acid, and an antioxidant system of five or more antioxidants, wherein the system comprises mixed octylated and butylated diphenylamine or benzeneamine-N-phenyl-reaction product with 2,4,4-trimethylpentane and 2-methylpropene (CAS number [184378-08-3] and sold as VANLUBE 961) (0.5%), benzenepropanoic acid, 3,5-bis(1,1-dimethylethyl)-4-hydroxy-2,2-bis[[3-[3,5-bis-(1,1-dimethylethyl)-4-hydroxyphenyl]-1-oxo-propoxy]methyl]-1,3propanediyl ester (CAS number [6683-19-8] and sold as IRGANOX 1010) (0.5%), benzenepropanoic acid, 3,5-bis(1,1-dimethylethyl)-4-hydroxy,-thiodi-2,1-ethanediyl ester (CAS number [41484-35-9] and sold as IRGANOX L115) (0.5%), alkylated phenyl alpha-naphthylamine or N-phenyl-ar-(1,1,3,3-tetramethylbutyl)-1-naphthylamine (CAS number [68259-36-9] and sold as IRGANOX L06) (0.5%), and liquid DL-alpha tocopherol; 2H-1-Benzopyran-6-ol,3,4-dihydro-2,5,7,8-tetramethyl-2-(4,8,12-trimethyltridecyl)-(CAS number [10191-41-0] and sold as IRGANOX E201) (1.0%), wherein the high temperature H1 food grade lubricant has less than 46% residue formation, a) vapor deposit of 3.9 mg or less and b) greater than 3% liquid fraction remaining after an oven pan test performed at 260° C. for 20 hours.

2. The lubricant of claim 1, wherein at least one neopentyl polyhydric alcohol comprises dipentaerythritol.

3. The lubricant of claim 1, wherein the five antioxidants are chosen from (a) benzenepropanoic acid, 3,5-bis(1,1-dimethylethyl)-4-hydroxy,2,2-bis[[3-[3,5-bis(1,1-dimethylethyl)-4-hydroxyphenyl]-1-oxopropoxy]methyl]-1,3-propanediyl ester (CAS number [6683-19-8]); (b) alkylated phenyl alpha naphthyl amine or N-phenyl-ar-(1,1,3,3,-tetramethylbutyl)-1-naphthalenamine (CAS number [68259-36-9]); (c) benzenepropanoic acid, 3,5-bis(1,1-dimethylethyl)-4-hydroxy-,thiodi-2,1-ethanediyl ester (CAS number [41484-35-9]); (d) mixed octylated and butylated diphenylamine or benzeneamine-N-phenyl- reaction product with 2,4,4-trimethylpentane and 2-methylpropene (CAS number [184378-08-3]); and (e) liquid DL-alpha tocopherol; 2H-1-Benzopyran-6-ol, 3,4-dihydro-2,5,7,8-tetramethyl-2-(4,8,12-trimethyltridecyl)-(CAS number [10191-41-0]).

4. The lubricant of claim 1, wherein the antioxidant system comprises five antioxidants.

5. The lubricant of claim 1, further comprising a rheology modifier.

6. The lubricant of claim 5, wherein the rheology modifier is present in an amount of about 0.2% to about 60% by weight of the lubricant.

7. The lubricant of claim 1, wherein the lubricant has a kinematic viscosity at 40° C. of about 60 to about 400 centistokes and a flash point of at least about 270° C.

8. The lubricant of claim 1, further comprising an additive in an amount of about 1%, or less by weight of the lubricant, wherein the additive is selected from the group consisting of a lubricating property modifier and a metal passivating agent.

9. The lubricant of claim 1, further comprising an additional one or more of an additive chosen from a metal passivating agent, a rheology modifier, a lubricating property modifier and combinations thereof.

10. A method of lubricating food processing equipment used at high temperatures where the lubricant incidentally contacts the food processed comprising: applying the food grade lubricant of claim 1 to the food processing equipment.

* * * * *